US008344970B2

(12) United States Patent
Fish et al.

(10) Patent No.: US 8,344,970 B2
(45) Date of Patent: Jan. 1, 2013

(54) TRANSISTOR CONTROL CIRCUITS AND CONTROL METHODS, AND ACTIVE MATRIX DISPLAY DEVICES USING THE SAME

(75) Inventors: David Andrew Fish, Haywards Heath (GB); John M. Shannon, Whyteleafe (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 1299 days.

(21) Appl. No.: 12/089,725

(22) PCT Filed: Sep. 29, 2006

(86) PCT No.: PCT/IB2006/053558

§ 371 (c)(1),
(2), (4) Date: Apr. 10, 2008

(87) PCT Pub. No.: WO2007/042957

PCT Pub. Date: Apr. 19, 2007

(65) Prior Publication Data

US 2008/0252573 A1 Oct. 16, 2008

(30) Foreign Application Priority Data

Oct. 12, 2005 (EP) ..... 05109491

(51) Int. Cl.
*G09G 3/30* (2006.01)

(52) U.S. Cl. ..... 345/76; 345/690; 345/204

(58) Field of Classification Search ..... 345/76–82, 345/204, 690, 211
See application file for complete search history.

(56) References Cited

U.S. PATENT DOCUMENTS

| | | | | |
|---|---|---|---|---|
| 7,071,932 | B2 * | 7/2006 | Libsch et al. | 345/211 |
| 7,612,749 | B2 * | 11/2009 | Libsch et al. | 345/82 |
| 8,044,893 | B2 * | 10/2011 | Nathan et al. | 345/76 |
| 2003/0020413 | A1 * | 1/2003 | Oomura | 315/169.3 |
| 2004/0046164 | A1 | 3/2004 | Kobayashi et al. | |

FOREIGN PATENT DOCUMENTS

| | | | |
|---|---|---|---|
| EP | 1130565 | A1 | 9/2001 |
| WO | WO2004015780 | A1 | 2/2004 |
| WO | WO2004066250 | A1 | 9/2004 |

OTHER PUBLICATIONS

Shannon et al: "Source-Gated Thin-Film Transistors"; IEEE Electron Device Letters, vol. 24, No. 6, Jun. 2003, pp. 405-407.
Balon et al: "Modeling of High-Current Source-Gated Transistors in Amorphous Silicon"; Applied Physics Letters 86, 073503 (2005), pp. 86-88.

* cited by examiner

*Primary Examiner* — Duc Dinh
(74) *Attorney, Agent, or Firm* — Kenneth Springer; Mark Beloborodov

(57) ABSTRACT

A transistor control circuit (74) comprises a source-gated thin film transistor (70), an input for receiving a drive voltage representing a desired control of the source-gated transistor and a current source (82) for causing a known current to pass through the source-gated transistor (70). A first capacitor (78) stores a resulting gate-source voltage of the source-gated transistor when the known current is passed through the source-gated transistor. The drive voltage is modified using the resulting gate-source voltage, and the modified voltage is used in the control of the source-gated transistor. This control can provide a translational shift in the operating characteristics of the transistor, and it has been found that this can compensate for ageing of the transistor, for non-uniformity between different devices, and for temperature variations.

19 Claims, 7 Drawing Sheets

TRANSISTOR CONTROL CIRCUITS AND CONTROL METHODS, AND ACTIVE MATRIX DISPLAY DEVICES USING THE SAME

This invention relates to transistor control circuits, and particularly but not exclusively to the control of thin film transistors in a manner which compensates for variations in the transistor characteristics through ageing and/or for variations between different transistor characteristics through non-uniformity over a large area substrate. This is of particular benefit for active matrix display devices.

In active matrix display devices, a transistor acts as a driving element to pass a current or voltage to the display element of the pixel.

Active matrix display devices employing electroluminescent, light-emitting, display elements are well known. The display elements commonly comprise organic thin film electroluminescent elements, (OLEDs), including polymer materials (PLEDs), or else light emitting diodes (LEDs). These materials typically comprise one or more layers of a semiconducting conjugated polymer sandwiched between a pair of electrodes, one of which is transparent and the other of which is of a material suitable for injecting holes or electrons into the polymer layer.

The display elements in such display devices are current-driven and a conventional, analogue, drive scheme involves supplying a controllable current to the display element. Typically, a current-source transistor is provided as part of the pixel configuration, with the gate voltage supplied to the current source transistor determining the current through the electroluminescent (EL) display element. A storage capacitor holds the gate voltage after the addressing phase. An address transistor is used to provide a data voltage to the current source part of the pixel drive circuit.

Active matrix liquid crystal display devices are also well known. The display elements in such display devices are voltage-driven and a conventional drive scheme involves supplying a data voltage to the liquid crystal pixel through an address/drive transistor. The data voltage is stored on a pixel capacitance (which may be the self-capacitance of the liquid crystal cell) before the pixel is isolated from the data line by switching off the address/drive transistor.

In each case, the address transistor of the pixel is turned on by a row address pulse on a row conductor. When the address transistor is turned on, a data voltage on a column conductor can pass to the remainder of the pixel circuit.

Amorphous silicon technology provides a low cost fabrication process for display devices. Unfortunately, the thin film amorphous silicon transistors which are used suffer threshold voltage drift over time (dependent on the voltage loading of the transistor over time), with the result that changes in pixel characteristics occur due to ageing of the display device. This is particularly an issue with current-driven display devices, in which the drive transistor is acting as an analogue current source, rather than a switch.

For voltage-addressed display devices, the address/drive transistor is operating as a switch, and this enables the address/drive transistor to be operated as a digital rather than analogue device, which gives improved tolerance to variations in characteristics. However, the voltage generation circuits of the driver circuits must provide accurate voltages, and the integration of these driver circuits onto the display substrate then presents difficulties in providing drive voltages which do not vary when there is ageing of the device or variations due to non-uniformities.

The problem of threshold voltage drift of amorphous silicon transistors has been a barrier to the integration of driver circuits onto amorphous silicon display substrates. Polycrystalline silicon is also used as the technology for manufacture of display devices, and driver circuits can then more readily be integrated onto a polycrystalline silicon substrate. However, these thin film devices suffer non-uniformity in their characteristics over the substrate area.

Thus, there remain problems both in forming pixel circuits using thin film transistors and in forming integrated driver circuitry using the thin film technology of the pixel array.

Various techniques have been developed for compensating for the ageing of amorphous silicon transistors, and the non-uniformity in characteristics of polyscrystalline silicon transistors. In each case, the compensation essentially involves providing tolerance to different threshold voltages.

To compensate for the ageing of amorphous silicon transistor characteristics for transistors used in current-addressed display pixels, circuits have been proposed for measuring the change in threshold voltage so that the pixel data can be corrected externally. In-pixel compensation schemes have also been proposed. In-pixel compensation schemes can, for example, use optical feedback paths from the display elements so that the drive conditions are varied in dependence on the display element outputs, and this can compensate both for variations in the drive transistor characteristics over time as well as variations in the display element characteristics over time.

The various compensation schemes that have been proposed can improve the performance stability and lifetime for specific situations, but the conventional transistor designs also have undesirably high power consumption, so that even with the uniformity and stability issues addressed, there is a need for improved circuits.

A new transistor technology has been developed by the applicant, and is termed "source-gated thin film transistor". The technology is described in detail in WO 2004/015780. These devices have a high output impedance and low voltage operation. This makes the devices suitable for low power and/or high gain applications.

However, these devices also suffer variations in characteristics over time or non-uniformities in device characteristics (again depending on whether amorphous or polycrystalline technology is used). These variations do not manifest themselves as a threshold voltage drift, so that the known compensation schemes for conventional thin film transistors are not appropriate.

According to the invention, there is provided a transistor control circuit, comprising:

a source-gated thin film transistor;

an input for receiving a drive voltage representing a desired control of the source-gated transistor;

a current source for causing a known current to pass through the source-gated transistor;

a first capacitor for storing a resulting gate-source voltage of the source-gated transistor when the known current is passed through the source-gated transistor; and means for modifying the drive voltage using the resulting gate-source voltage, and using the modified voltage in the control of the source-gated transistor.

This circuit controls a source-gated transistor by varying a drive signal to take account of the operating point of the transistor. This operating point is determined by sampling the gate-source voltage for a given current. By controlling the transistor using a difference value, a translational shift in the operating characteristics can be implemented, and it has been found that this can compensate for ageing of the transistor, for non-uniformity between different devices, and for temperature variations.

The source-gated transistor preferably comprises opposing source and gate electrodes, with a source barrier, a gate insulating layer and a semiconductor body sandwiched between the source and gate electrodes.

For example, the source-gated transistor may be for conduction using charge carriers of a predetermined conductivity type, and may comprise:

a semiconductor body layer;

a source electrode extending across a source region of the semiconductor body layer defining a Schottky potential barrier between the source electrode and the source region of the semiconductor body layer, a drain electrode connected to the semiconductor body layer; and a gate electrode for controlling transport of carriers of the predetermined carrier type from the source electrode to the source region of the semiconductor body layer across the barrier when the source region is depleted;

wherein the gate electrode is arranged in an overlapping relationship to the source electrode on the opposite side of the semiconductor body layer to the source electrode having a gate insulator layer between the gate electrode and the semiconductor body layer; and the gate electrode is spaced from the source electrode by at least the combined full thickness of the semiconductor body layer and the gate insulator over the whole of the gate-controlled region of the Schottky barrier.

Alternatively, the source-gated transistor may be for conduction using charge carriers of a predetermined conductivity type, and may comprise:

a semiconductor body layer having a thickness of at least 10 nm;

a source electrode extending across a source region of the semiconductor body layer defining a potential barrier between the source electrode and a source region of the semiconductor body layer, a drain electrode connected to the semiconductor body layer; and a gate electrode for controlling transport of carriers of the predetermined carrier type from the source electrode to the source region of the semiconductor body layer across the barrier when the source region is depleted;

wherein the gate electrode is arranged in an overlapping relationship to the source electrode on the opposite side of the semiconductor body layer to the source electrode having a gate insulator layer between the gate electrode and the semiconductor body layer; and the gate electrode is spaced from the source electrode by at least the combined thickness of the full thickness of the semiconductor body layer and the gate insulator over the whole of the gate-controlled region of the source barrier.

The circuit may further comprise a second capacitor for storing the drive voltage. in this way, the drive voltage is stored on one capacitor, and the gate-source voltage is stored on another. These two capacitors can then together form the means for modifying. The two capacitors form a capacitor arrangement, and voltages can be tapped from different terminals of the capacitor arrangement in order to provide a modified voltage. For example, the first and second capacitors can be in series, with a drive voltage input to the circuit being provided to the junction between the first and second capacitors.

The first and second capacitors can be in series between the gate and source of the source-gated transistor. When the transistor has reached a stable condition, the voltages stored on the capacitors can be arranged such that the resulting gate-source voltage is provided on the first capacitor, for example by ensuring no charge is stored on the second capacitor.

A control transistor can be provided between the source of the source-gated transistor and the current source. The control transistor then determines when the current sampling operation takes place.

A holding transistor may be provided for providing a predetermined voltage to the gate of the source-gated transistor during storing on the first capacitor of the resulting gate-source voltage. This can ensure that no voltage is across the second capacitor, as mentioned above.

The invention also provides an active matrix electroluminescent display device, comprising an array of pixels, each pixel comprising an electroluminescent display element, and a circuit of the invention, wherein the source-gated thin film transistor comprises a current source transistor for the pixel.

Thus, the circuit enables compensation for the ageing and/or non uniformities of the transistor when used as an in-pixel current source. Each pixel preferably further comprises an address transistor connected between a data line and the input of the controlling circuit. The circuits can be formed using amorphous silicon.

The invention also provides a drive circuit for an active matrix liquid crystal display device, comprising an array of output circuits, each output circuit comprising a digital to analogue converter, and a circuit of the invention, wherein the source-gated thin film transistor comprises an output drive transistor.

Thus, the circuit enables compensation for the ageing and/or non uniformities of the transistor when used as a driver circuit for an LCD display. Each output circuit preferably further comprises an input transistor connected between the digital to analogue converter and the input of the controlling circuit.

An output switching transistor may be connected between the source of the source-gated transistor and a pixel output, and this functions as a multiplexing switch.

The invention also provides an active matrix liquid crystal display comprising an array of displays pixels and column driver circuitry integrated onto the same substrate as the pixel array, for providing pixel drive signals to the columns of pixels, wherein the column driver circuitry comprises a drive circuit of the invention. The array of display pixels and the drive circuit can be formed using polycrystalline silicon.

The invention also provides a method of controlling a source-gated thin film transistor, comprising:

receiving a drive voltage representing a desired control of the source gated transistor;

driving a known current through the source-gated transistor;

sampling the resulting gate-source voltage of the source-gated transistor when the known current is passed through the source-gated transistor; and controlling the source-gated transistor using a difference between the drive voltage and the resulting gate-source voltage.

The invention also provides an amplifier, comprising:

first and second opposite type source-gated thin film transistors in series between power supply lines, with the gates of the first and second transistors connected together at an input node;

an input for receiving an input voltage for amplification;

a capacitor between the input and the input node, for storing an offset voltage; and a shorting transistor connected between the input node and the output of the amplifier.

For a better understanding of the invention, embodiments will now be described, purely by way of example, with reference to the accompanying drawings in which.

The figures are purely diagrammatic and not to scale. Like or similar components are given the same reference numerals in different figures.

This invention relates to the use of source-gated transistors with compensation for ageing and/or non-uniformities. Before describing the invention, the technology of the source-gated transistor will first be outlined, although WO 2004/015780 is referred to for further details, and the full content of that document is incorporated herein by way of reference material.

Figure 1:
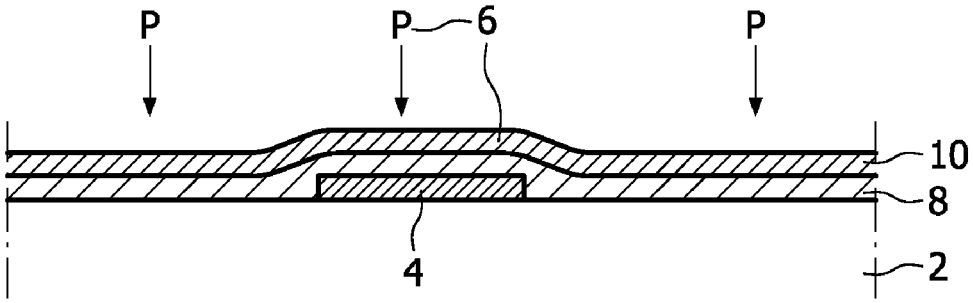
FIG. 1 shows a first step in the manufacture of an example of source-gated transistor (SGT)
Figure 2:
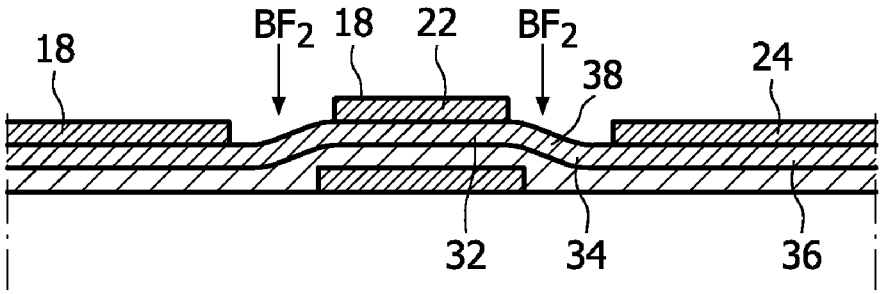
FIG. 2 shows a second step in the manufacture of the example of source-gated transistor of FIG. 1.

An example of source-gated transistor, its manufacture and properties will now be discussed with reference to FIGS. 1 to 3.

Figure 3:
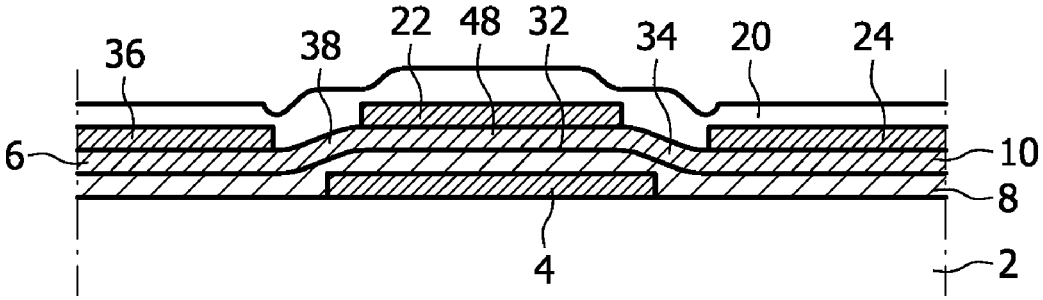
FIG. 3 shows a third step in the manufacture of the example of source-gated transistor of FIGS. 1 and 2.

FIG. 3 illustrates an example of an n-type conduction source-gated transistor, i.e. transistor conduction is using electrons. The transistor is formed on substrate 2. Semiconductor body layer 10, with a source electrode 22 extends laterally across a depletable source region 32 of the semiconductor body layer 10, defining a barrier 48 at the interface between the source electrode 22 and the source region 32 of the semiconductor body layer. A pair of drain electrodes 24 are provided, each extending laterally and being connected to a drain region 36 of the semiconductor body layer. The drain region 36 of the semiconductor body layer is spaced laterally from the source region 32, so defining an intermediate region 34 of the semiconductor body layer between the source and drain regions.

The barrier is a Schottky barrier and an implantation 6 is provided in the semiconductor body layer 10 to control the height of this barrier.

On the opposite side of the semiconductor body layer to the source electrode, there is a gate electrode 4 in an overlapping relationship to the source electrode 22 and having a gate insulator layer 8 between the gate electrode 4 and the semiconductor body layer 10. This overlapping insulated gate electrode 4 is coupled to the source barrier 48 only through the thickness of the semiconductor body layer 10 and gate insulator 8 so that, when the source region 32 is depleted, voltage applied to the gate electrode 4 controls transport of carriers of the predetermined carrier type across the barrier 48 from the source electrode 22 to the source region 32 of the semiconductor body layer 10. Passivation layer 20 is provided over the top surface.

Viewed from another perspective, the source-gated transistor of FIG. 3 comprises a semiconductor layer 10 that provides a body portion 32,34 of the transistor between a source 22 of the electrons (i.e. the conduction carriers of the predetermined conductivity type of the transistor) and a drain 24,34 for these charge carriers. The insulated gate of the source-gated transistor comprises a gate electrode 4 coupled to a region 32 of the body portion 32,34 via an intermediate gate-dielectric layer 8. The source comprises a barrier 48 to the said carriers between a source electrode 22 and the semiconductor layer 10. This barrier 48 inhibits carrier flow from the source 22 into the body portion 32,34 except as controlled by the insulated gate 4,8. The source 22 and the insulated gate 4,8 are located at respective opposite major sides of the semiconductor layer 10 in an opposed laterally-overlapping relationship which separates the source 22 from the insulated gate 4,8 by at least an intermediate thickness of the body portion 32,34 between the opposite major sides of the semiconductor layer 10. The laterally-overlapping insulated gate 4,8 is coupled to the source barrier 48 via this intermediate thickness of the semiconductor layer 10. Upon depletion of the region 32 across the intermediate thickness of the semiconductor layer 10 from the insulated gate 4,8, this coupling permits the voltage applied between the gate and source electrodes 4 and 22 to control transistor conduction by controlled emission of said carriers (for example, by thermionic-field emission) across the source barrier 48.

In order to encourage conduction across the main part of the barrier 48 (i.e. rather than conduction at the barrier edge), it is advantageous for the source barrier 48 to be provided with field-relief at least at the lateral edge of the source barrier 48 facing the drain 24,34. One such field relief measure (using compensation doping) is incorporated in the FIG. 3 example: the compensation doped region 38 provides field relief.

It can be seen that the basic structure of a source-gated transistor is one in which opposing source and gate electrodes, have a source barrier, a gate insulating layer and a semiconductor body sandwiched between them. The source electrode extends across a source region of the semiconductor body layer defining a Schottky potential barrier between the source electrode and the source region of the semiconductor body layer. The gate electrode controls transport of carriers from the source electrode to the source region of the semiconductor body layer across the barrier when the source region is depleted. The gate electrode is spaced from the source electrode by the combined full thickness of the semiconductor body layer and the gate insulator over the whole of the gate-controlled region of the Schottky barrier. The semiconductor body layer can have a thickness of at least 10 nm.

To form the device using one example of amorphous silicon manufacturing process, a bottom gate 4 is deposited and patterned using a first mask on a glass substrate 2. Then, a 300 nm silicon nitride gate insulation layer 8 and a 150 nm undoped hydrogenated amorphous silicon layer 10 are applied to act as the semiconductor body using known techniques. A second mask is used to define silicon islands above the gate electrodes. A dose of $1\times10^{14}$ $cm^{-2}$ phosphorous 6 can be implanted into the surface at 10 KeV to control the source barrier height, as shown in FIG. 1.

A chromium metal layer 18 is deposited onto the structure and defined using a third mask to define a source electrode 22 and a pair of drain 24 electrodes spaced away from the source electrode 22 on either side of the source electrode 22. A boron difluoride implant 38 of $1\times10^{14}$ $cm^{-2}$ at 12 KeV can be made using the source 22 and drain 24 electrodes for autoalignment, the boron implant 38 compensating the phosphorous. This is shown in FIG. 2. The boron implant is into the intermediate region 34 of the amorphous silicon layer 10, between the source region 32 in contact with the source 22 and the drain region 36 in contact with the drain. A passivation layer 20 is deposited over the top of the structure. The structure is then annealed at 250° C. for 30 minutes to activate the implanted phosphorous and boron.

The chromium of the source 22 and drain 24 electrodes make a Schottky barrier to the amorphous silicon body. The phosphorus doping is used to achieve a suitably low Schottky barrier height for electrons to enable high current operation at low gate voltages. As will be appreciated by the skilled person, the phosphorous doping may be varied to fine-tune the Schottky barrier height and hence the gate voltage needed.

Figure 4:
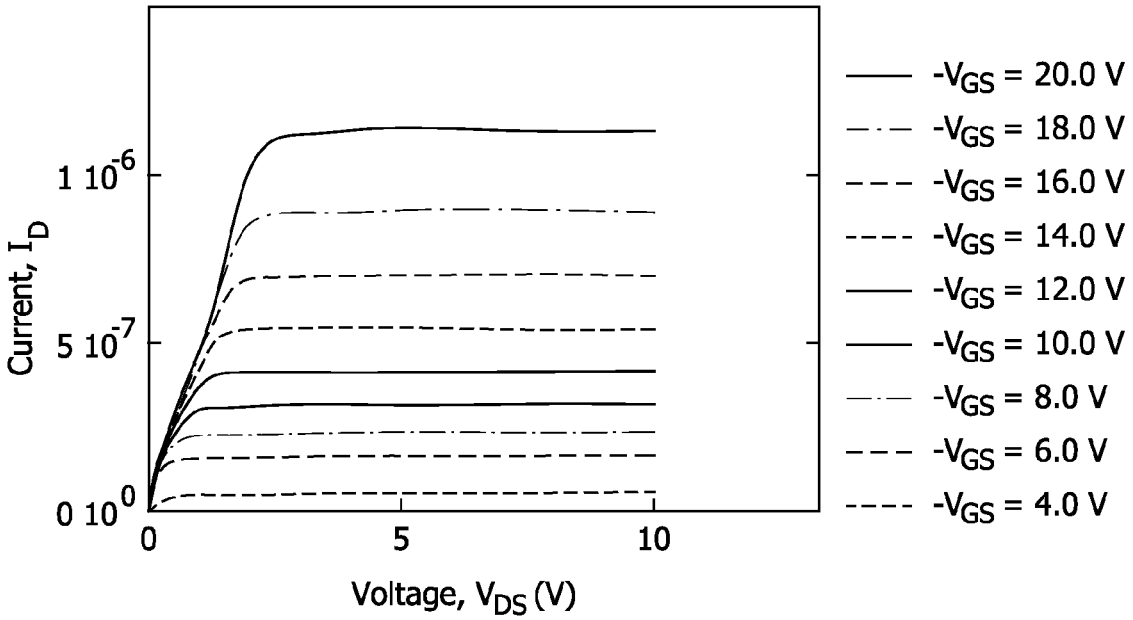
FIG. 4 shows the measured transistor characteristics for a source-gated transistor.
Figure 5:
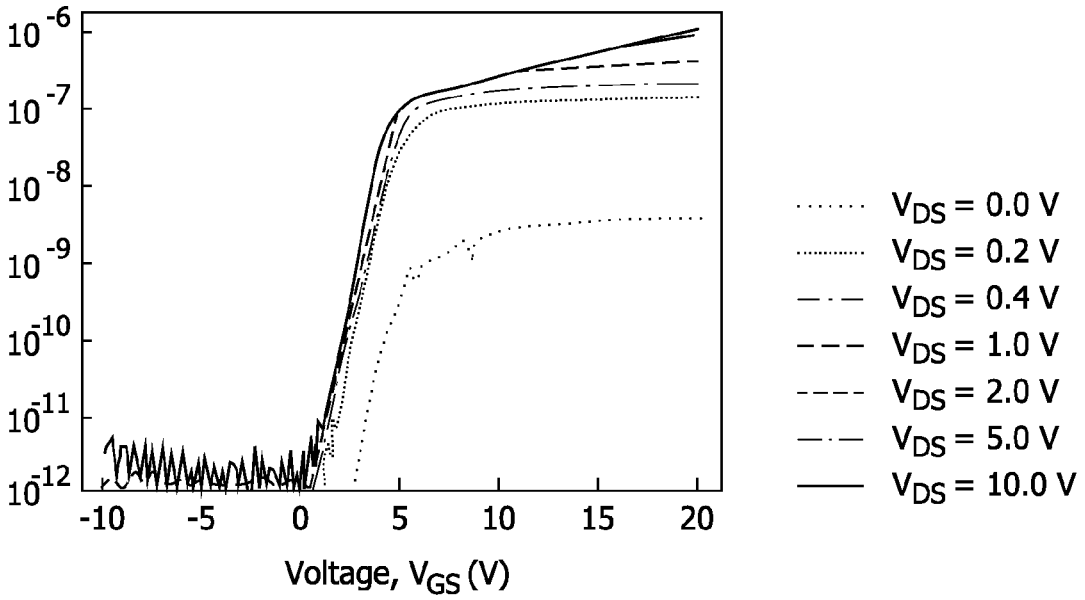
FIG. 5 shows the measured transfer characteristics for the source-gated transistor measured in FIG. 4.

FIGS. 4 and 5 show the characteristics of one example of source-gated transistor with a 600 μm source width (perpendicular to the source-drain direction). For this example, the semiconductor body layer has a thickness of 100 nm, and the gate is 300 nm thick SiN.

FIG. 4 shows the current versus drain-source voltage for a range of applied gate-source voltages, and FIG. 5 shows the log drain-source current versus gate-source voltage.

Figure 6:
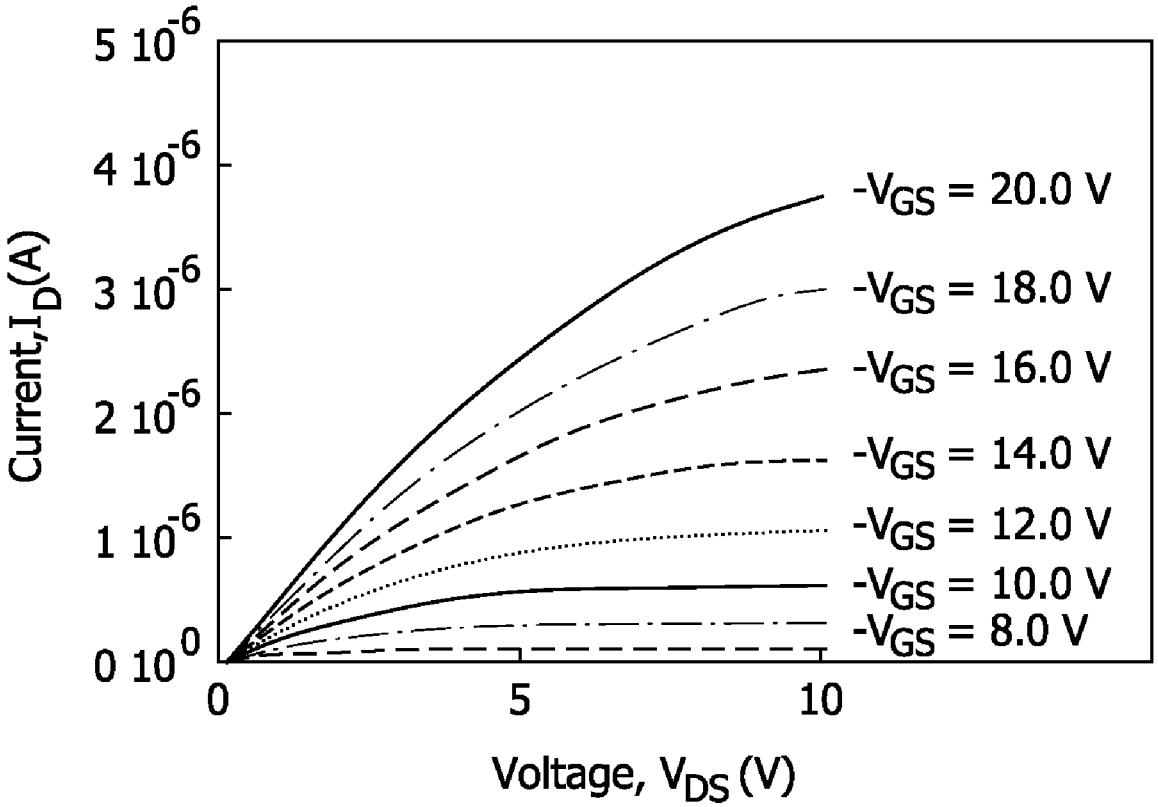
FIG. 6 shows the measured transistor characteristics for a comparative TFT.

The characteristics scale with source width and are minimally affected by the source-drain separation down to 2 μm separation. This shows that the source barrier is well screened from the drain field. For comparison, the characteristics of a TFT with the same deposited layers as the source-gated transistor and operating at a similar current level are illustrated in FIG. 6 (corresponding to the plot of FIG. 4).

It is seen that the pinch-off voltage is much greater for the TFT than for the source-gated transistor. For example, with 12 V on the gate, the source-gated transistor could be operated as an amplifier down to a drain voltage of 2V while the TFT would need 8V.

After pinch-off the current is largely independent of the drain-source voltage. Changes in the drain voltage have very little effect on the conduction, since such changes hardly effect the injection of carriers over the barrier. This gives rise to the very flat curves seen in FIG. 4, i.e. to a very high output impedance, of order $10^{9}\Omega$. The pinch off voltage may also be seen to be small, in the range 0.5V to 2.5V for the device tested. This is much lower than for the conventional TFT tested, as may be seen from FIG. 6.

The source-gated transistor can be implemented in hydrogenated amorphous silicon or in low temperature polycrystalline silicon (LTPS), and it is much more stable than a standard FET, has a lower saturation voltage and higher output impedance. For LTPS devices, non-uniformities in current are still an issue. For amorphous silicon devices, the stability at high currents is also an issue for many display applications.

If these non-uniformity and ageing issues could be addressed, the advantages of the source-gated transistor could be used to advantage, in particular the major reduction in power dissipation.

Although the source-gated transistor is more stable than the FET, it is nevertheless very difficult to make an analog device that is sufficiently stable at high current levels for display applications using amorphous material. The main instability mechanism is defect generation as in an FET.

This invention follows from the recognition that, in the case of the source-gated transistor, this defect generation results in a translational shift in the transfer characteristics. Furthermore, the other main parameter which influences stability, that of temperature, also results in a translational shift in the transfer characteristics. This shift may be considered as movement parallel to the y-axis of the set of characteristic curves of FIG. 4.

The invention is thus based on the recognition that source-gated transistor instability mechanisms can be compensated in amorphous or polysilicon by using a circuit that can detect the change in gate voltage needed to maintain a given current through the source-gated transistor. This approach can compensate for stability in amorphous silicon devices or for non-uniformity in LTPS devices.

Figure 7:
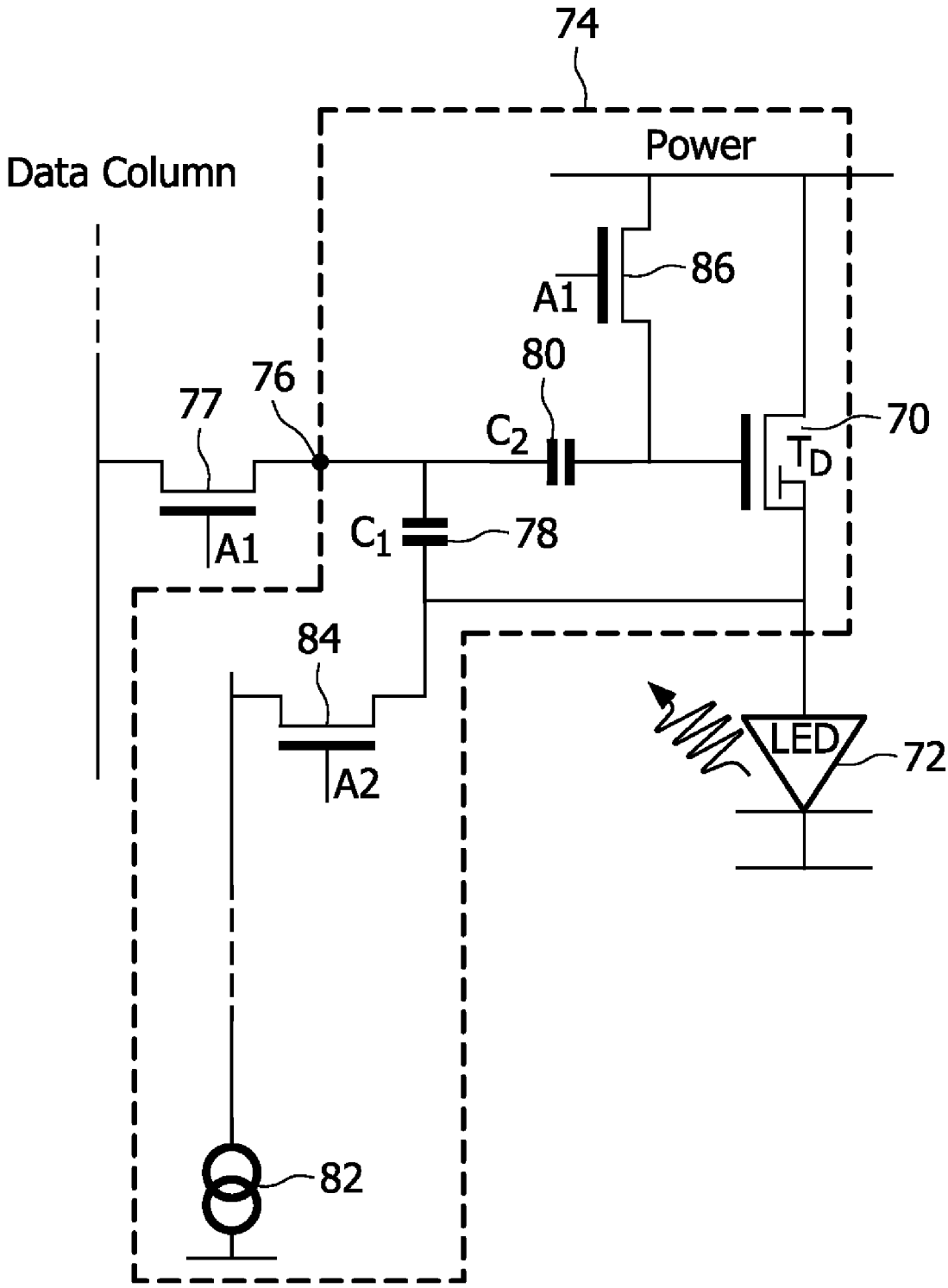
FIG. 7 shows a first example of control circuit of the invention used as part of an in-pixel current source circuit for an active matrix electroluminescent display device.

FIG. 7 shows a first example of compensation circuit of the invention, for use in compensating for the ageing of an amorphous silicon drive transistor used as the in-pixel current source of an active matrix electroluminescent display device.

The pixel circuit comprises a drive transistor 70 in the form of a source-gated transistor, as described above. This transistor is used as a current source device, providing a controllable current to an electroluminescent display element 72, dependent on the gate voltage applied to the transistor.

The drive transistor forms part of a transistor control circuit 74, which receives as input 76 a drive voltage representing a desired control of the source-gated transistor to achieve a particular brightness output. The voltage at input 76 is provided from a data column through an address transistor 77.

A first capacitor 78 and a second capacitor 80 are provided between the source and gate of the drive transistor. The first capacitor 78 is for storing a gate-source voltage of the source-gated transistor for a known current passing through the source-gated transistor, and the second capacitor 80 is for storing the data input voltage. The combined effect of the two capacitors is to modify the drive voltage at the input 76 using a previously stored gate-source voltage, and to use the modified voltage in the control of the source-gated transistor.

As shown, the voltage input 76 to the circuit is provided to the junction between the first and second capacitors 78, 80.

In order to enable a gate-source voltage for a given current to be stored on the first capacitor 78, a current source 82 is provided, and is connected to the source of the drive transistor 70 though a control transistor 84. This control transistor can be used to cause the current source current to be driven through the drive transistor 70. The first and second capacitors 78,80 and the control transistor 84 are thus in series between the gate of the source-gated transistor 70 and the current source 82.

A holding transistor 86 enables a predetermined voltage (in the example shown, the high power line voltage) to be coupled to the gate of the source-gated transistor 70. This can be used to ensure that the gate-source voltage of the transistor is stored on the first capacitor 78 only, when the fixed current is driven through the transistor 70.

The operation of the circuit will be described below, with reference to FIG. 8. The circuit controls the source-gated transistor 70 by varying the input drive signal at input 76 to take account of the operating point of the transistor. This operating point is determined by sampling the gate-source voltage for a given current. By controlling the transistor using a difference value, a translational shift in the operating characteristics can be implemented, and it has been found that this can compensate for ageing of the transistor, for non-uniformity between different devices, and for temperature variations.

Each row of pixels is controlled by two address lines; a first address line A1 for the address transistor 77 and for the holding transistor 86, and a second address line A2 for the control transistor 84.

Figure 8:
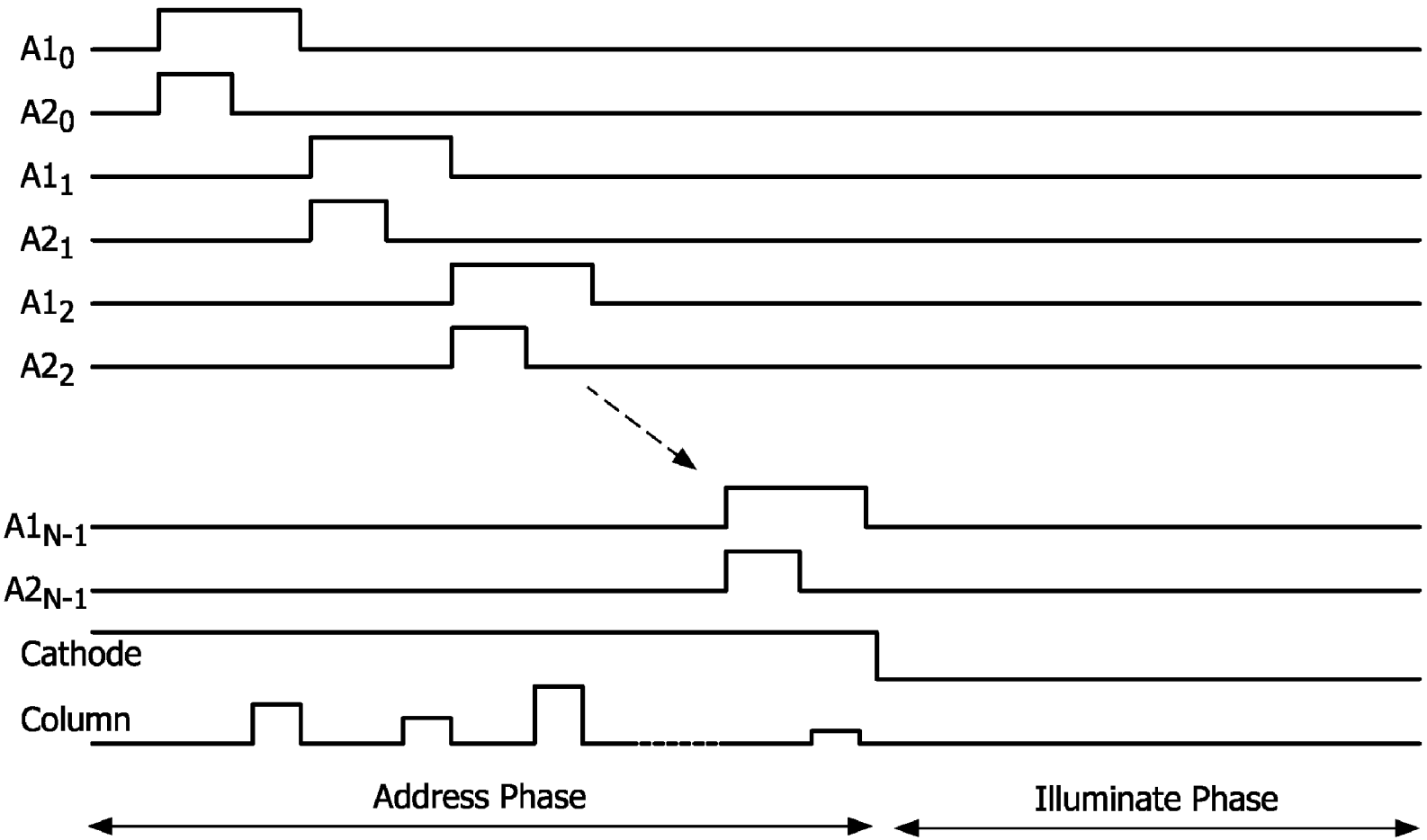
FIG. 8 shows timing waveforms for the pixel circuit of FIG. 7.

As shown in FIG. 8, the addressing comprises an address phase, during which (modified) data values are stored in all pixels, followed by an illumination phase. During the address phase, the display element 72 is reverse biased by a high cathode voltage, as shown. The display element 72 therefore does not emit, or provide a path for current leakage. During the illumination phase, the cathode is low and the drive transistor operates as a current source.

Each row is addressed in turn during the address phase, and this involves switching both address lines high, and subsequently switching address line A2 low before switching address line A1 low.

With both address lines initially high, the voltage on the column is set equal to the power line voltage. As a result, both sides of the second capacitor 80 are connected to the power line voltage, one side through the holding transistor 86 and one side through the address transistor 77. The current source 82 is also connected to sink the fixed current through the transistor 70. The fixed current is large and therefore charges any line capacitance quickly, and this current charges the first capacitor 78 with a gate-source voltage corresponding to the fixed current.

When the second address line A2 line goes low, the first capacitor 78 is isolated. The data column can then be provided with the data value, which will be a potential greater than the power line potential. The second capacitor 80 is then charged to the data voltage.

The gate-source voltage of the transistor 70 stored on the first capacitor 78 contains any information on the shift in the characteristic of the transistor, and the result of the capacitor arrangement is to provide a gate-source voltage which is the data voltage less the stored gate-source voltage. Therefore shifts in the characteristics of the transistor 70 are compensated.

When the first address line A1 is brought low, the desired modified gate-source voltage is stored across the two capacitors in series, with the input drive voltage effectively having been modified.

This circuit provides voltage-programmed operation, after a constant current programming step with the resultant voltages subtracted to form the gate-source voltage. There is no measurement of the threshold voltage, as it has been recognised that the change in characteristics can be characterised by a translational shift in the transistor current versus voltage characteristic. The current programming phase can be short, because a constant high current is always used to generate a large voltage on the first capacitor to measure the translational characteristic shift.

This example of circuit is of particular interest for implementation using amorphous silicon, and provides compensation for voltage-induced ageing of the drive transistor.

Figure 9:
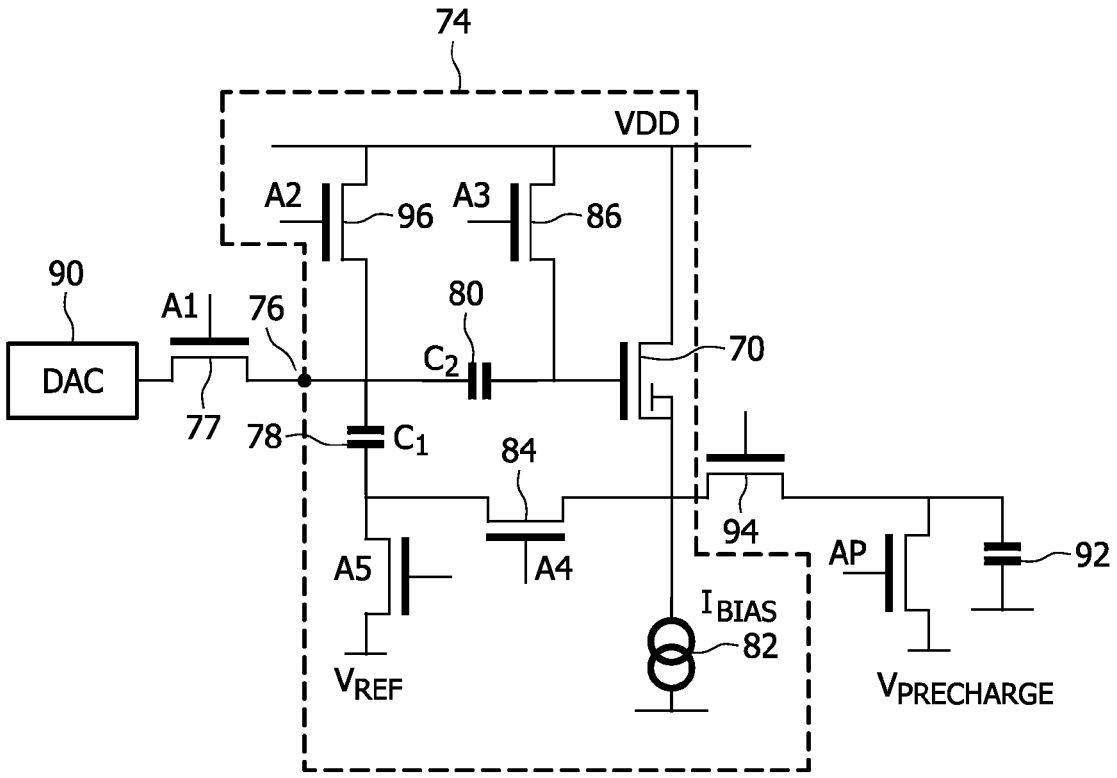
FIG. 9 shows a second example of control circuit of the invention used as part of an integrated column driver circuit for an active matrix liquid crystal display device.

FIG. 9 shows a second example of compensation circuit of the invention, for use in compensating for the non-uniformity of a polycrystalline silicon transistor used as part of a column driver circuit for an active matrix liquid crystal display device.

The source-gated transistor can also be implemented using low temperature polysilicon technology. The high output impedance and the low saturation voltage of source-gated transistors makes them particularly suitable for the integrated LPTS driver circuits of a low power LCD column driver.

Typically, circuits such as source followers are used in these driver circuits, as buffers for digital to analogue converter circuit outputs. The low saturation voltage enables these to be implemented in a manner that consumes less power.

The circuit of FIG. 9 is the output buffer circuit for one column within a column driver circuit.

The circuit of FIG. 9 operates in a similar manner to the circuit shown in FIG. 7, and the same reference numbers are used for the same components.

Again, the source-gated transistor 70 forms part of a transistor control circuit 74, with first and second capacitors 78,80 in series between the gate and source. In this circuit, the control transistor 84 is also in series with the two capacitors between the source and gate, and the current source 82 connects to the transistor source.

The output of a digital to analogue converter circuit 90 is provided to the input 76 through the address transistor 77, and the source-gated transistor is used to charge a column capacitance 92 (including an addressed pixel) to a desired voltage, which is determined by a feedforward loop between the source of the transistor (which is the output of the circuit) and the input.

The output of the circuit is provided to the column through an output switching (multiplexing) transistor 94. A second holding transistor 96 is provided for holding one side of the second capacitor 80 to the power line voltage.

A transistor is provided for supplying a reference voltage $V_{REF}$ to the lower terminal of the capacitor $C_1$, controlled by the address line A5, and a further transistor is provided for supplying a precharge voltage $V_{PRECHARGE}$ to the output, controlled by the address line AP.

The circuit has six address lines; address line A1 for the address transistor 77, address line A2 for the second holding transistor, address line A3 for the (first) holding transistor 86, address line A4 for the control transistor 84, and the address lines A5 for loading a reference voltage and the precharge address line AP.

Initially, address lines A2, A3 and A4 are turned on, so that a current is drawn to charge the first capacitor 78 to a voltage sufficient to pass the fixed current through the source-gated transistor, and then this is stored. During this time, the same voltage is supplied to each side of the second capacitor 80.

The address lines A2 and A4 then turn off, so that the first capacitor 78 is isolated, and so that the junction between the two capacitors can be driven to a new voltage. This also means that the current source current $I_{BIAS}$ can only be sourced from the source gated transistor, as the transistor 84 is turned off.

The voltage stored across the capacitor 78 is $V_{BIAS}=V_T+\sqrt{(2I_{BIAS}/\beta)}$, where $V_T$ is the threshold voltage of the source gated transistor, and $\beta$ is the transconductance.

The address line A1 also turns on and the DAC voltage charges the second capacitor 80 to a potential $V_{DAC}$ above the power line voltage.

The address lines A1 and A3 then turn off and A5 turns on to apply the reference voltage $V_{REF}$ to the bottom terminal of the capacitor 78.

The gate voltage of the source gated transistor becomes:

$$V_G=V_{REF}+V_{BIAS}-V_{DAC}.$$

The terms $V_{BIAS}$ and $V_{DAC}$ are the voltages across the two capacitors.

The transistor 70 must apply the bias current $I_{BIAS}$ as it is in series with the current source 82, so the source moves to the voltage:

$$V_S=V_G-V_T-\sqrt{(2I_{BIAS}/\beta)}=V_G-V_{BIAS}$$

The resultant source voltage is $V_S = V_{REF} - V_{DAC}$, so that the non-uniformity sources have been removed, namely the threshold voltage and the mobility, that partially defines the transconductance β.

A uniform column voltage can thus be achieved with a low power because of the low saturation voltage of the source-gated transistor.

As the source follower circuit cannot sink current the column must be initially pre-charged to a low voltage $V_{PRE-CHARGE}$ by pulsing a precharge address line (AP) so that the column subsequently be charged up to a voltage defined by the source of the source-gated transistor.

To achieve low power consumption, the source follower transistor voltage should be as low as possible, as the bias current will always need to flow. With a standard TFT as a source follower, the minimum drain source voltage to maintain saturation is defined by $V_{DS} \geqq V_{GS} - V_T = \sqrt{(2I_{BIAS}/\beta)}$.

Therefore the power supply must be at least $\sqrt{(2I_{BIAS}/\beta)}$ above the maximum voltage that is required on the column of the display to drive the liquid crystal.

However the saturation voltage for a source gated transistor is much lower that this value, so the power supply can be brought nearer to the maximum required column voltage. Therefore power is saved.

The current source can also be implemented using an n-type source gated transistor which will enable current source power supply to be brought nearer to the minimum voltage required on the column. This further saves power.

Figure 10:
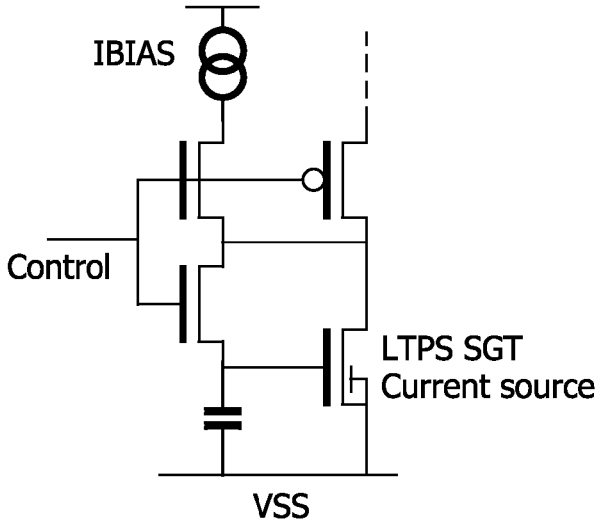
FIG. 10 shows a current source circuit for use with the circuit of FIG. 9.

This extra source gated transistor will also need correction and this can be easily achieved using a standard switched mirror configuration and a well defined external current, as shown in FIG. 10.

FIG. 10 shows a current source transistor for sampling an external current source $I_{BIAS}$, when the control line "Control" switches the n-type transistor on and the p-type transistor off. This forces the current source current through the source-drain of the source gated transistor, once the circuit is stable and no current is being drawn by the gate of the source gated transistor.

A programming phase is required and this can easily be achieved in a field blanking period when the columns are not driven. The control line "Control" can implement this programming phase.

The very high output impedance of the source gated transistor enables the source voltage to be more accurately defined i.e. the current sunk by this current source will not vary as the source voltage moves.

The circuit of FIG. 9 (and optionally using the current mirror circuit of FIG. 10 to generate the bias current) can be used to form an integrated column driver for an active matrix liquid crystal display, for example with the array of display pixels and the drive circuit formed using polycrystalline silicon.

Other low power and high gain circuits can be implemented using source-gated transistors, and similar compensation schemes can be applied.

Inverter gain stages used in LCD integrated column drivers can be implemented using source-gated transistors that have a higher output impedance than standard TFTs. In this way, a single inverter stage can produce the same level of gain as a series of standard TFT inverter gain stages. The lower saturation voltage also means lower power supplies. The source-gated transistor then gives high gain with less area consumption and low power.

Figure 11:
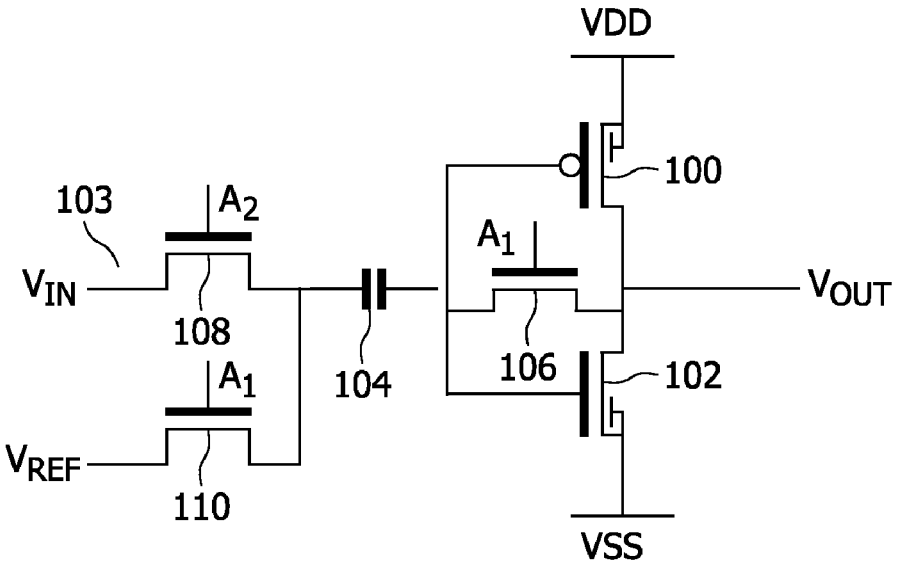
FIG. 11 shows an amplifier circuit of another aspect of the invention.

An example inverter gain stage is shown in FIG. 11. The gain stage comprises an amplifier with first 100 and second 102 opposite type source-gated thin film transistors in series between power supply lines. The gates of the first and second transistors are connected together at an input node. An input 103 receives an input voltage for amplification. A capacitor 104 is provided between the input 103 and the input node, and is for storing an offset voltage. A shorting transistor 106 is connected between the input node and the output ($V_{OUT}$) of the amplifier.

The input is provided through a first input transistor 108 to one side of the capacitor 104, and a reference voltage input ($V_{REF}$) is also provided through a second input transistor 110 to the one side of the capacitor 104.

The amplifier is operable in two modes.

In a first mode, the address line A1 is high to turn on the shorting transistor and the second input transistor 110. The input and output of the amplifier are connected together, and the voltage settles at a level between the power supply lines which takes into account the characteristics of the two transistors. The difference between this settling voltage (which represents changes in the relative characteristics of the two transistors) and the reference voltage is stored on the capacitor.

In a second mode, the address line A2 is high and the address line A1 is low, so that the input node and output are not coupled together by the shorting transistor, and the input voltage for amplification is provided to the input node through the capacitor. The capacitor provides compensation for (relative) variations in the characteristics of the two transistors.

Figure 12:
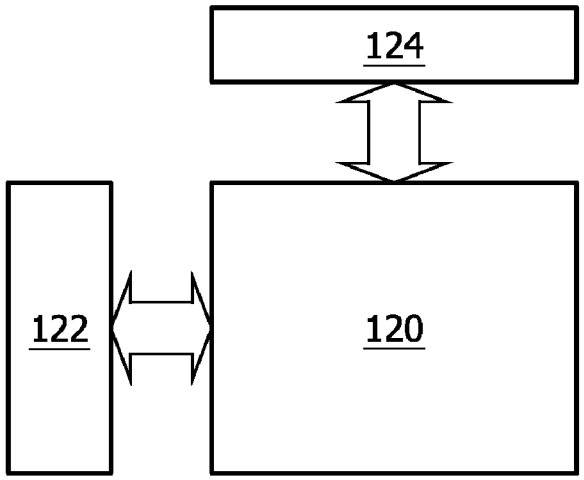
FIG. 12 shows a display device of the invention.

FIG. 12 shows a display device of the invention, comprising a pixel array 120, a row driver 122 and a column driver 124. The source-gate transistor may be used as part of the pixel circuit or as part of the column driver integrated onto the substrate of the pixel array, or both. The invention may also be used in the row driver circuitry.

The circuits above thus correct for source-gated transistor instabilities and non-uniformities. Only a small number of specific circuits have been shown, and the invention may be implemented in many different ways, as will be apparent to those skilled in the art.

The invention can be applied to n-type or p-type transistor circuits, or circuits using combinations of these. Furthermore, the compensation may involve addition or subtraction of a reference voltage depending on the circuit design, but always provides modification to take account of changes in the transistor characteristics relative to a reference position.

The examples concern the use of the transistors in display applications. There are of course numerous other applications where ageing is an issue or uniformity over a large area substrate, such as imaging devices, touch input devices and others.

Various other modifications will be apparent to those skilled in the art.

The invention claimed is:

1. A transistor control circuit, comprising:

a source-gated thin film transistor;

an input for receiving a drive voltage representing a desired control of the source-gated transistor;

a current source for causing a known current to pass through the source-gated transistor;

a first capacitor for storing a resulting gate-source voltage of the source-gated transistor when the known current is passed through the source-gated transistor; and means for modifying the drive voltage using the resulting gate-source voltage, and using the modified voltage in the control of the source-gated transistor.

2. A circuit as claimed in claim 1, wherein the source-gated transistor comprises opposing source and gate electrodes, with a source barrier, a gate insulating layer and a semiconductor body sandwiched between the source and gate electrodes.

3. A circuit as claimed in claim 1, wherein the source-gated transistor is for conduction using charge carriers of a predetermined conductivity type, and comprises:

a semiconductor body layer;

a source electrode extending across a source region of the semiconductor body layer defining a Schottky potential barrier between the source electrode and the source region of the semiconductor body layer, a drain electrode connected to the semiconductor body layer; and a gate electrode for controlling transport of carriers of the predetermined carrier type from the source electrode to the source region of the semiconductor body layer across the barrier when the source region is depleted;

wherein the gate electrode is arranged in an overlapping relationship to the source electrode on the opposite side of the semiconductor body layer to the source electrode having a gate insulator layer between the gate electrode and the semiconductor body layer; and the gate electrode is spaced from the source electrode by at least the combined full thickness of the semiconductor body layer and the gate insulator over the whole of the gate-controlled region of the Schottky barrier.

4. A circuit as claimed in claim 1 wherein the source-gated transistor is for conduction using charge carriers of a predetermined conductivity type, and comprises:

a semiconductor body layer having a thickness of at least 10 nm;

a source electrode extending across a source region of the semiconductor body layer defining a potential barrier between the source electrode and a source region of the semiconductor body layer, a drain electrode connected to the semiconductor body layer; and a gate electrode for controlling transport of carriers of the predetermined carrier type from the source electrode to the source region of the semiconductor body layer across the barrier when the source region is depleted;

wherein the gate electrode is arranged in an overlapping relationship to the source electrode on the opposite side of the semiconductor body layer to the source electrode having a gate insulator layer between the gate electrode and the semiconductor body layer; and the gate electrode is spaced from the source electrode by at least the combined thickness of the full thickness of the semiconductor body layer and the gate insulator over the whole of the gate-controlled region of the source barrier.

5. A circuit as claimed in claim 3, wherein the source-gated transistor further comprises a field relief structure at the lateral edge of the source electrode facing the drain electrode.

6. A circuit as claimed in claim 1, further comprising a second capacitor for storing the drive voltage.

7. A circuit as claimed in claim 6, wherein the first and second capacitors are in series, with a drive voltage input to the circuit being provided to the junction between the first and second capacitors.

8. A circuit as claimed in claim 6, wherein the first and second capacitors are in series between the gate and source of the source-gated transistor.

9. A circuit as claimed in claim 8, wherein a control transistor is provided between the source of the source-gated transistor and the current source.

10. A circuit as claimed in claim 1, further comprising a holding transistor for providing a predetermined voltage to the gate of the source-gated transistor during storing on the first capacitor of the resulting gate-source voltage.

11. An active matrix electroluminescent display device, comprising:

an array of pixels, each pixel comprising an electroluminescent display element, and a circuit as claimed in claim 1, wherein the source-gated thin film transistor comprises a current source transistor for the pixel.

12. A device as claimed in claim 11, wherein each pixel further comprises an address transistor connected between a data line and the input of the controlling circuit.

13. A device as claimed in claim 11, wherein the current source transistor and the display element are in series between power lines.

14. A device as claimed in claim 11, wherein the circuits are formed using amorphous silicon.

15. A drive circuit for an active matrix liquid crystal display device, comprising:

an array of output circuits, each output circuit comprising a digital to analogue converter, and a circuit as claimed in claim 1, wherein the source-gated thin film transistor comprises an output drive transistor.

16. A drive circuit as claimed in claim 15, wherein each output circuit further comprises an input transistor connected between the digital to analogue converter and the input of the controlling circuit.

17. A drive circuit as claimed in claim 15, wherein each output circuit further comprises an output switching transistor connected between the source of the source-gated transistor and a pixel output.

18. An active matrix liquid crystal display comprising an array of displays pixels and column driver circuitry integrated onto the same substrate as the pixel array, for providing pixel drive signals to the columns of pixels, wherein the column driver circuitry comprises a drive circuit as claimed in claim 15.

19. A display as claimed in claim 17, wherein the array of display pixels and the drive circuit are formed using polycrystalline silicon.

* * * * *